US007254903B2

(12) United States Patent
Cho et al.

(10) Patent No.: US 7,254,903 B2
(45) Date of Patent: Aug. 14, 2007

(54) FOOTWEAR WITH VENTILATING AND SHOCK-ABSORBING DEVICE

(76) Inventors: Jong Soo Cho, 158-29, Gamjeon-Z Dong, Sasang-Gu, Busan 619-201 (KR); Hyeon San Jeong, 201, 1016-32, Guseo-2 Dong, Keumjung-Gu Busan, 60P-202 (KR)

( * ) Notice: Subject to any disclaimer, the term of this patent is extended or adjusted under 35 U.S.C. 154(b) by 0 days.

(21) Appl. No.: 11/265,663

(22) Filed: Nov. 2, 2005

(65) Prior Publication Data

US 2006/0143943 A1 Jul. 6, 2006

Related U.S. Application Data

(63) Continuation of application No. PCT/KR2005/000033, filed on Jan. 6, 2005.

(51) Int. Cl.
*A43B 7/06* (2006.01)

(52) U.S. Cl. ..... 36/3 R; 36/3 B

(58) Field of Classification Search ..... 36/3 B, 36/3 A, 3 R

See application file for complete search history.

(56) References Cited

U.S. PATENT DOCUMENTS

| | | | | | |
|---|---|---|---|---|---|
| 2,010,151 | A * | 8/1935 | Helwig | 36/3 B |
| 4,336,661 | A * | 6/1982 | Medrano | 36/44 |
| 4,590,689 | A * | 5/1986 | Rosenberg | 36/3 B |
| 4,999,932 | A * | 3/1991 | Grim | 36/3 B |
| 5,341,581 | A * | 8/1994 | Huang | 36/3 B |
| 5,477,626 | A * | 12/1995 | Kwon | 36/3 B |
| 5,813,140 | A * | 9/1998 | Obeid | 36/3 R |
| 5,826,349 | A * | 10/1998 | Goss | 36/3 R |
| 5,996,250 | A * | 12/1999 | Reed et al. | 36/3 R |
| 6,085,444 | A * | 7/2000 | Cho | 36/3 B |
| 6,370,799 | B1 * | 4/2002 | Thatcher | 36/3 B |
| 2005/0132606 | A1 * | 6/2005 | Passke et al. | 36/3 B |
| 2005/0178023 | A1 * | 8/2005 | Hammonds | 36/3 B |
| 2005/0283997 | A1 * | 12/2005 | Wang | 36/3 B |

FOREIGN PATENT DOCUMENTS

| | | | |
|---|---|---|---|
| FR | 2532158 | * | 8/1982 |
| GB | 2262024 | * | 9/1993 |
| JP | 6-339402 | * | 6/1994 |

* cited by examiner

*Primary Examiner*—Marie Patterson
(74) *Attorney, Agent, or Firm*—Tychman & Park LLC

(57) ABSTRACT

Disclosed is footwear including a ventilation and shock-absorbing device having an air pump and a check valve for passing air supplied by the air pump. The footwear includes an air chamber provided at a front of the check valve for storing the air supplied through an inlet passage connected to the check valve, and an air tube having one or more discharge holes for discharging the air stored in the air chamber into the footwear.

16 Claims, 6 Drawing Sheets

FOOTWEAR WITH VENTILATING AND SHOCK-ABSORBING DEVICE

This application is a continuation of pending International Patent Application No. PCT/KR2005/000033 filed Jan. 6, 2005 which designates the United States.

FIELD OF THE INVENTION

The present invention relates to ventilated footwear, and more particularly, to footwear with a ventilation and shock-absorbing device, the device having an air chamber in a front of the footwear to absorb shock applied to a sole of a foot and ventilate an inside of the footwear when walking.

BACKGROUND OF THE INVENTION

In general, footwear is means for protecting feet of a pedestrian, and is made of a leather, synthetic resin or the like having no ventilating function. Since it is difficult to circulate air within the footwear, the footwear gives out an offensive odor due to perspiration or moisture, which causes athlete's foot, eczema or the like.

There has been proposed footwear having a ventilation device to solve the above problem. The footwear is composed of an air pump installed under a sole for pumping air, a check valve for passing the air supplied by the air pump in one direction, and an air discharge tube connected to the check valve and discharging the air passed through the check valve to an interior of the footwear.

According to the ventilated footwear composed as described above, the air pump is repeatedly compressed to pump the air, so that the external air is continuously supplied to the interior of the footwear. The air circulation may effectively remove the perspiration or offensive odor in the footwear, but has the following drawbacks.

Conventional ventilated footwear has only ventilating function for circulating the air in the footwear, but does not provide shock absorbing means for alleviating shock applied to the feet when walking. The pedestrian has a feeling of fatigue induced by the shock continuously applied to the feet when walking.

More perspiration comes likely out between the toes than the sole. Conventional ventilated footwear supplies the air in the footwear, but cannot supply intensively to a particular portion. Accordingly, there is a drawback in that an effective ventilating function is not obtained.

SUMMARY OF THE INVENTION

Therefore, an object of the present invention is to solve the problems involved in the prior art, and to provide footwear with a ventilation and shock-absorbing device, the device having an air chamber in a front of the footwear to absorb shock applied to a sole of a foot and ventilate an inside of the footwear when walking.

Another object of the preset invention is to provide footwear with a ventilation and shock-absorbing device, which is adapted to locally supply air to a portion where sweats easily, thereby increasing a ventilation performance.

Still another object of the present invention is to provide footwear with ventilation and shock-absorbing device, of which a size of a discharge passage is selected according to a desired purpose, thereby properly adjusting ventilating and cushioning functions.

Still another object of the present invention is to provide footwear with a ventilation and shock-absorbing device, of which first and second branches have different size to differentially supply air between toes.

Still another object of the present invention is to provide footwear with a ventilation and shock-absorbing device, of which air discharged in the footwear is mixed with the far infrared rays or components useful to the human.

In order to accomplish the above and other objects, there is provided a footwear including a ventilation and shock-absorbing device having an air pump and a check valve for passing air supplied by the air pump, the footwear comprising: an air chamber provided at a front of the check valve for storing the air supplied through an inlet passage connected to the check valve; and an air tube having one or more discharge holes for discharging the air stored in the air chamber into the footwear.

Herein, there is provided ventilated footwear with ventilating and cushioning functions repeatedly achieved using walking motions of a pedestrian (i.e., a foot's heel comes into contact with a ground, and then a foot's sole comes into contact with the ground). An air pump is installed to a portion corresponding to the foot's heel to primarily absorb the shock, and an air chamber is installed to a portion to the foot's sole to store the sucked air and thus absorb the shock applied to the sole. Therefore, the ventilating and shock-absorbing functions may be continuously achieved when walking.

BRIEF DESCRIPTION OF THE DRAWINGS

The above objects, other features and advantages of the present invention will become more apparent by describing the preferred embodiment thereof with reference to the accompanying drawings, in which.

DETAILED DESCRIPTION OF THE DRAWINGS

Reference will now be made in detail to preferred embodiments of the present invention, examples of which are illustrated in the accompanying drawings.

Figure 1:
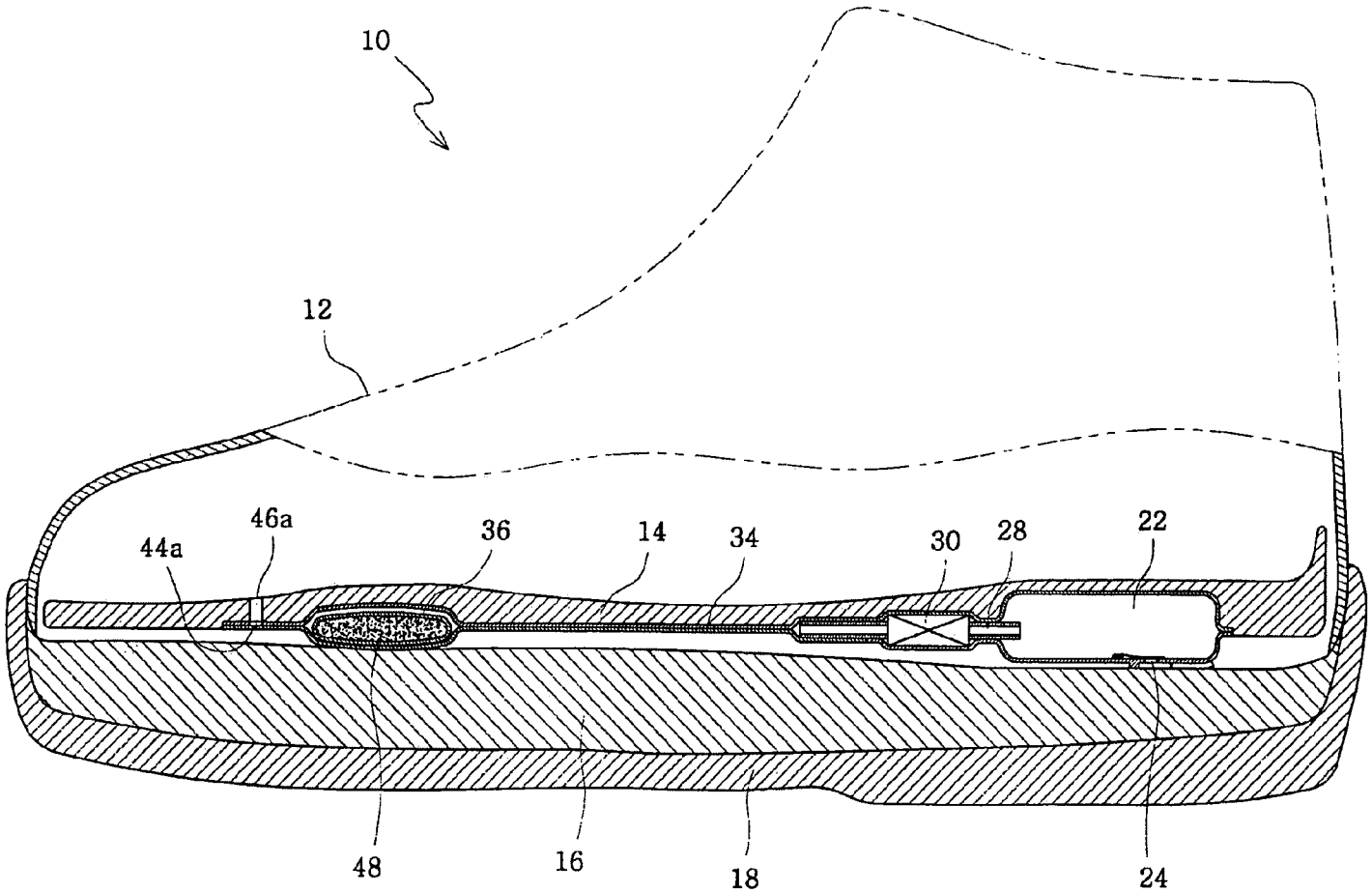
FIG. 1 is a cross-sectional view of footwear with a ventilation and shock-absorbing device according to a preferred embodiment of the present invention.

FIG. 1 is a cross-sectional view of footwear with a ventilation and shock-absorbing device according to the present invention. Referring to FIG. 1, ventilated footwear 100 includes a shoe upper 12 forming a shape of the footwear, an insole 14 (or slipsole) forming a bottom of the shoe upper 12, a midsole 16, and an outsole 18.

Also, the ventilated footwear 100 includes a ventilation device 20 on a bottom surface, preferably under the insole 14. Although the embodiment is related with only the ventilation device 20 installed under the insole 14, the ventilation device 20 may be formed in the midsole 16 through insert injection molding or may be installed between the midsole 16 and the outsole 18, which is apparent to those skilled in the art.

Figure 2:
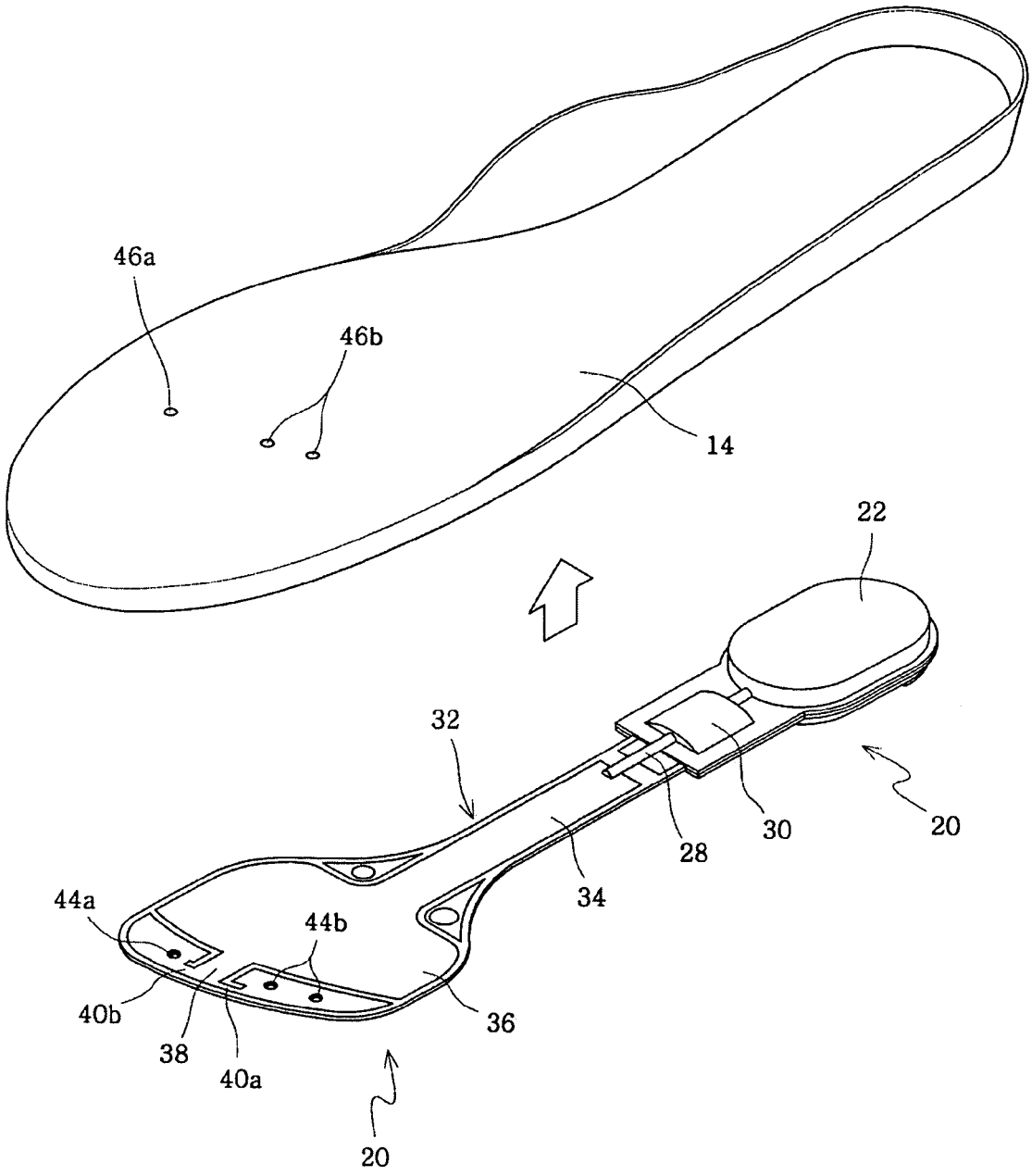
FIG. 2 is an exploded perspective view depicting an insole and a ventilation device installed to a bottom of the insole in FIG. 1.
Figure 3:
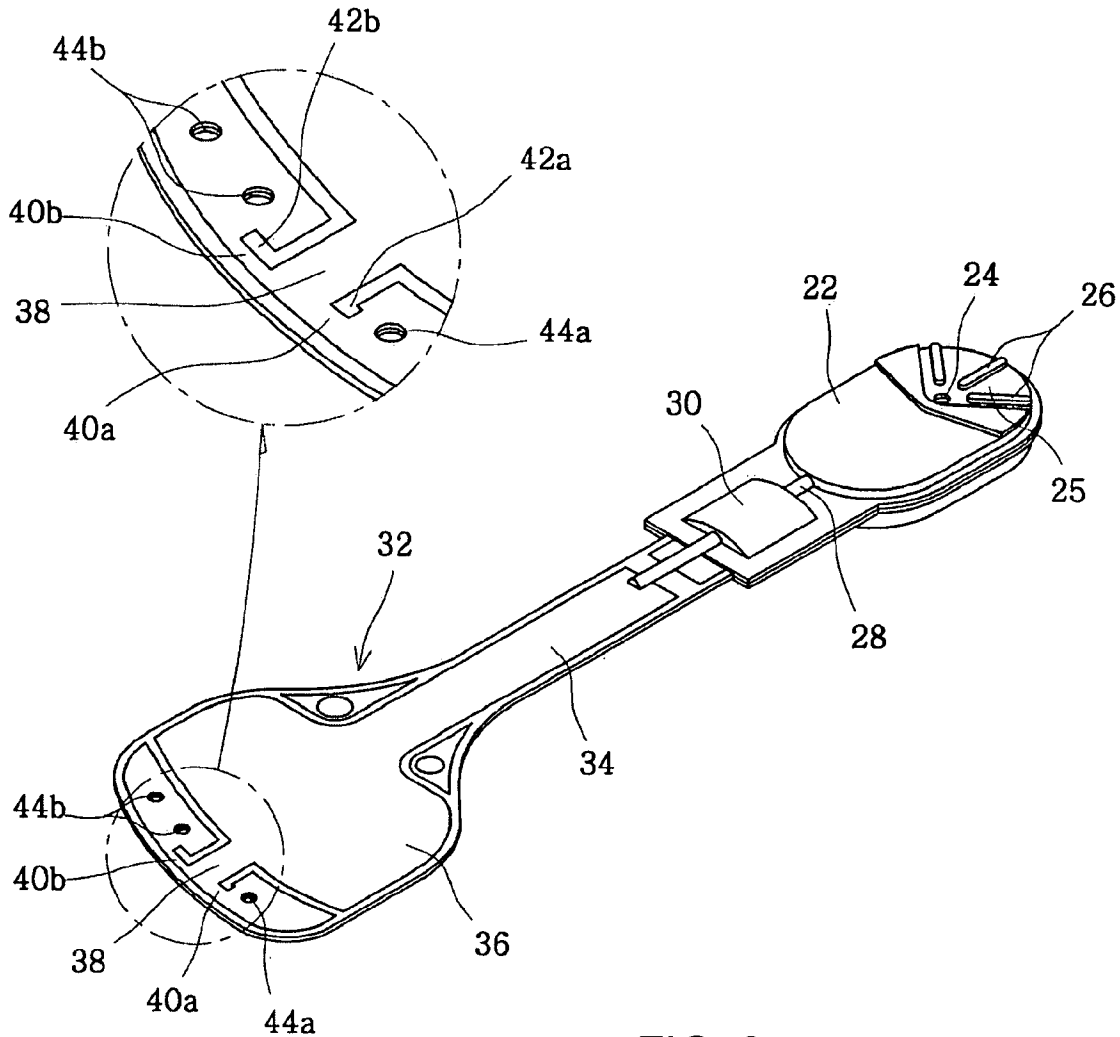
FIG. 3 is a perspective view depicting a bottom of the ventilation device in FIG. 2.
Figure 4:
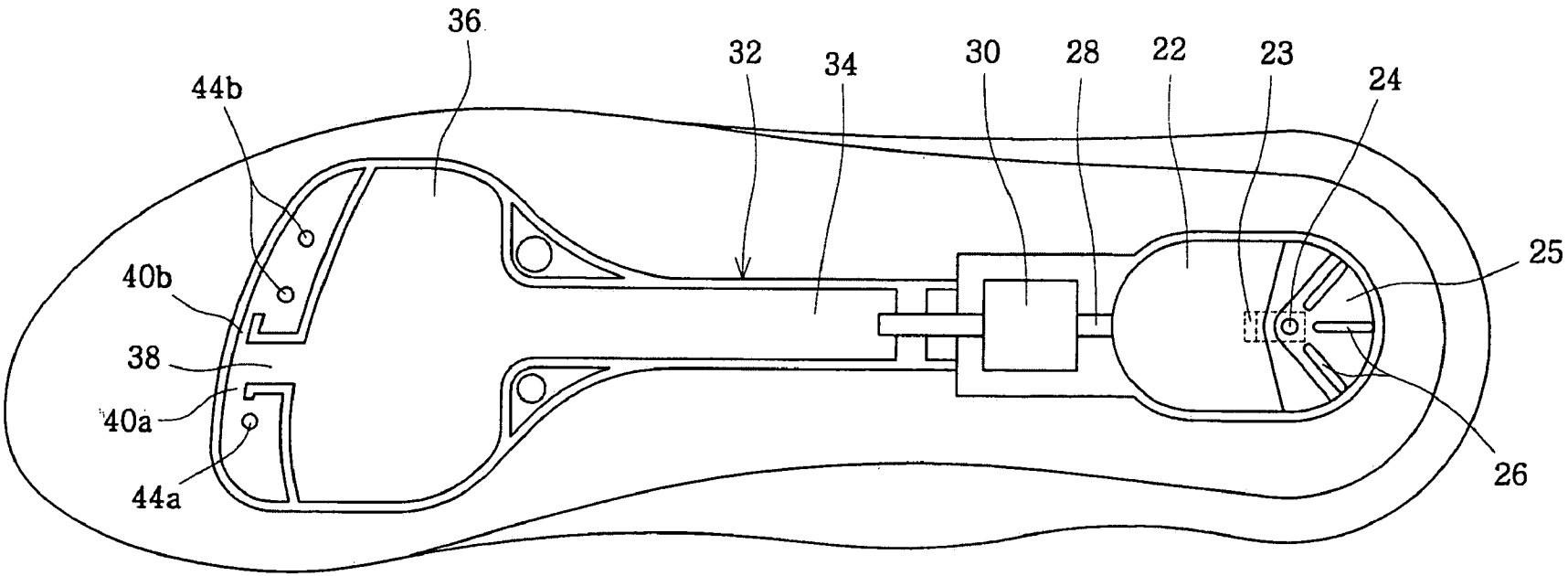
FIG. 4 is a bottom view of a ventilation device in FIG. 2.

FIGS. 2 through 4 are views depicting a detailed construction of the ventilation device 20 according to the present invention. Referring to the figures, the ventilation device 20 includes an air pump 22 at a rear portion thereof. The air pump 22 is formed with an intake hole 24 penetrating a center of the bottom surface. The air pump 22 is repeatedly compressed by a pressing force of the foot when walking to supply air into an interior of the footwear through the intake hole 24. The air pump 22 is provided on the bottom surface thereof with a plurality of guide pieces 26 radially formed at constant intervals around the intake hole 24. These guide pieces 26 form a gap 25 between the bottom surface of the air pump 22 and the midsole 16 to smoothly suck the air through the intake hole 24.

Also, the ventilation device 20 includes a resilient film 23 attached to an inside of the intake hole 24. The resilient film 23 is resiliently bent by the pressure of the air sucked into the intake hole 24 to open the intake hole 24 and prevent the air sucked into the air pump 22 from being outwardly discharged.

In addition, the ventilation device 20 includes an inlet pipe 28 installed to a front of the air pump 22 for supplying the air to the air tube 32, and a check valve 30 installed to an intermediate portion of the inlet pipe 28. The check valve 30 serves as a backflow cutoff valve, and since it is widely known in the art, the detail construction will not described herein.

A front end of the inlet pipe 28 is connected to an air tube 32, preferably an inlet passage 34 formed at the air tube 32. The air tube 32 discharges the air supplied by the air pump 22 into vent holes 46*a* and 46*b* formed at the insole 14 through discharge holes 44*a* and 44*b*. The air tube 32 is formed by high frequency heating edges of resin sheets overlapped top and bottom.

The air tube 32 is provided with an air chamber 36 communicating with the inlet passage 34 and having a size larger than the inlet passage 34. The air chamber 36 is means for absorbing shock applied to a foot of a pedestrian by providing the foot with cushion. In other words, when the air is supplied to the air chamber 36 through the inlet pipe 28 and the inlet passage 34 by the pumping operation of the air pump 22, the air chamber 36 is expanded. After the sole of the foot comes in contact with the air chamber 36, the air chamber 36 absorbs the shock applied to the sole of the foot, and is resiliently pressed to discharge the air into a discharge passage 38. Then, the air chamber 36 is restored to its original shape to provide the sole of the foot with the cushion, Meanwhile, the air chamber 36 is provided with the discharge passage 38 formed at the front through the high frequency heating. A plurality of discharge holes 44*a* and 44*b* are formed on both sides of the discharge passage 38. The discharge holes 44*a* and 44*b* are a passage for supplying the air stored in the air chamber 36 into the discharge holes 44*a* and 44*b*. The discharge passage 38 may adjust shock-absorbing and ventilating performance of the air chamber 36 according to a diameter of the discharge passage 38. More specifically, if the diameter of the discharge passage 38 is increased, a lot of air can be discharged at a time, which reduces a cushioning function of the air chamber 36. Meanwhile, since a lot of air is discharged at a time, a ventilating function is increased. If the diameter of the discharge passage 38 is reduced, a small amount of air is discharged, which increases the cushioning function of the air chamber 36. Meanwhile, since a small amount of air is gradually discharged, the ventilating function is decreased. In other words, a producer can select the diameter of the footwear in line with a user's design.

The discharge holes 44*a* and 44*b* are communicated with the vent holes 46*a* and 46*b* formed at the front of the insole 14, so that the air supplied from the discharge passage 38 is locally discharged toward toes, where sweat easily, in the footwear through the vent holes 46*a* and 46*b*. One discharge hole 44*a* is positioned between a big toe and a second toe to discharge the air, and other discharge holes 44*b* are positioned between other toes to discharge the air.

The discharge passage 38 is provided at the front thereof with first and second bent portions 42*a* and 42*b* to form first and second branches 40*a* and 40*b* for supplying the air into the discharge holes 44*a* and 44*b*. Preferably, the first and second branches 40*a* and 40*b* are made to have different diameter, for example, the first branch 40*a* has a diameter larger than that of the second branch 40*b*. As such, much more air can be supplied between the big toe and the second toe to differentially supply the air.

Preferably, the first and second bent portions 42*a* and 42*b* are made to have different length, for example, the first bent portion 42*a* has a length longer than that of the second bent portion 42*b*. As such, the air can be quickly discharged into the first branch 40*a*.

Also, the air chamber 36 may be filled with a functional member 48 that can radiate a material useful to a human, such as far infrared rays. The functional member 48 includes germanium, charcoal, deodorizer, or the like.

Function of the ventilated footwear will now be described with reference to FIGS. 5 and 6.

Figure 5:
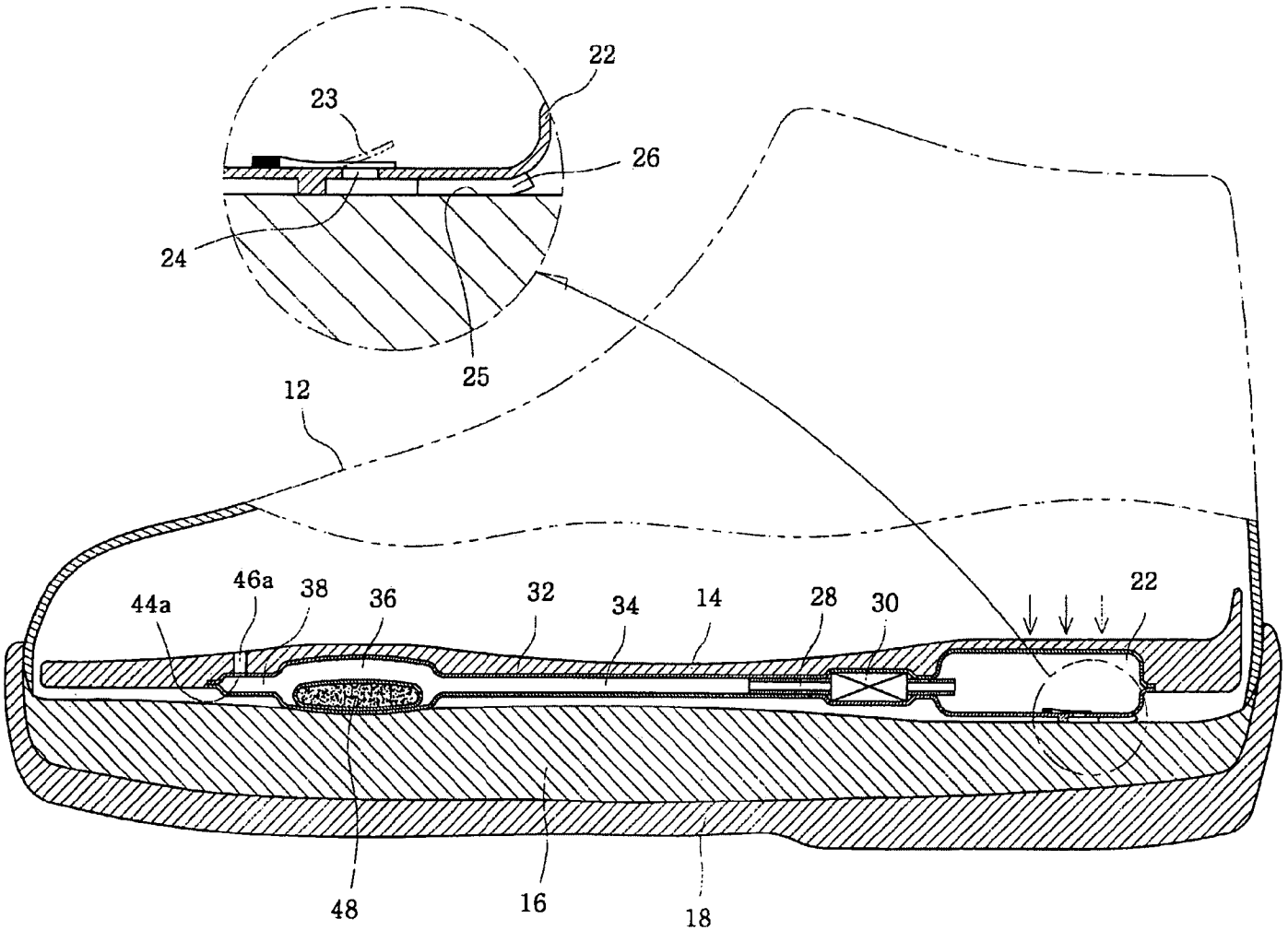
FIGS. 5 and 6 are views depicting a process of sucking air in the footwear.

While the footwear according to the present invention is worn when walking, when a heel portion of the pedestrian comes into contact with a ground, as shown in FIG. 5, the air pump 22 is compressed to suck in the air through the intake hole 24.

The air sucked in the air pump 22 is discharged through the check valve 30 installed to the inlet pipe 28, and is stored in the air chamber 36 through the air tube 32, preferably the inlet passage 34 formed at the air tube 32. Accordingly, the air chamber 36 is expanded by inflow of the air.

Figure 6:
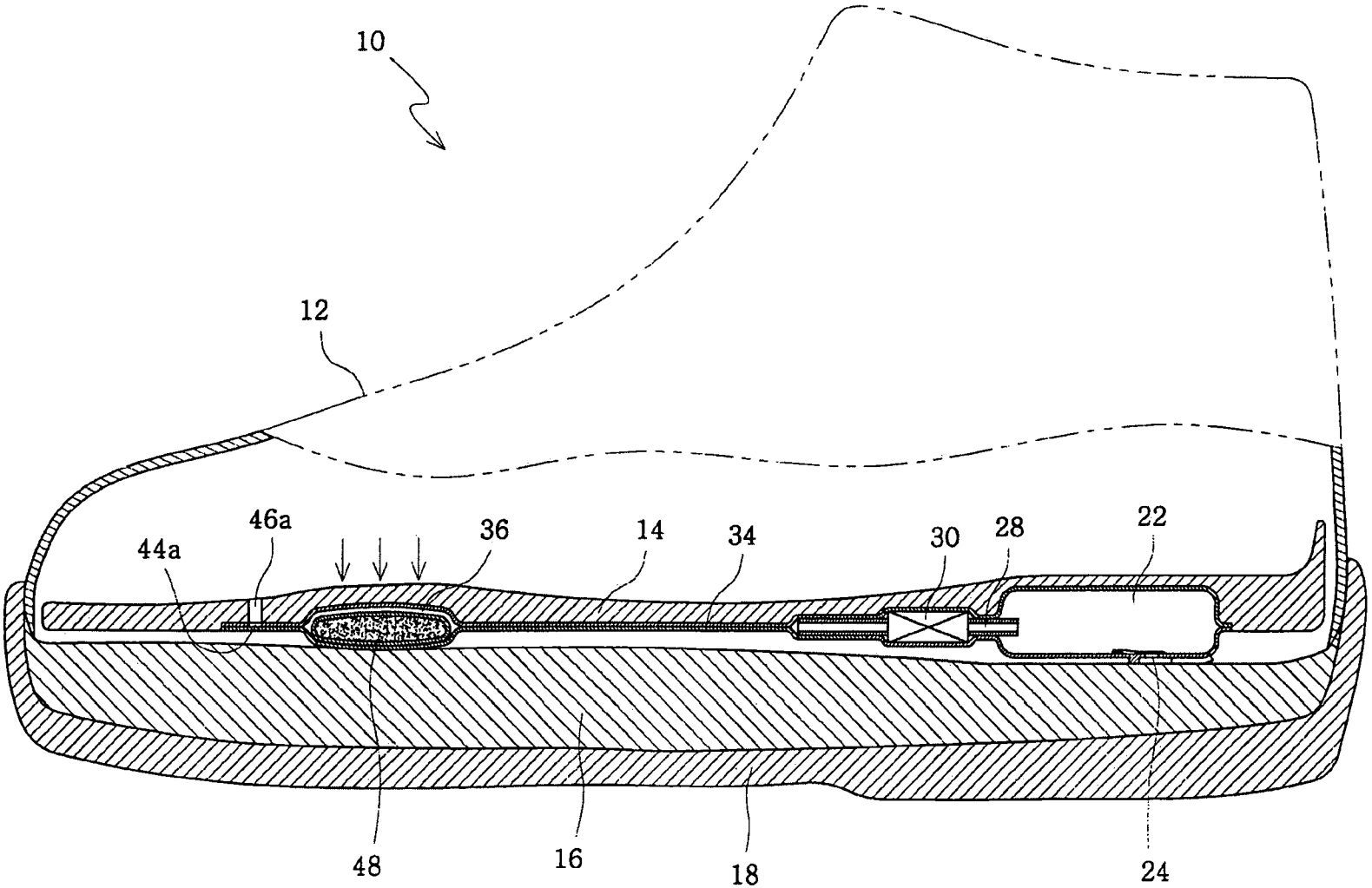

Then, when the foot's sole of the pedestrian comes into contact with the ground, as shown in FIG. 6, the air chamber 36 is compressed by the foot's sole. As such, the air chamber 36 is resiliently compressed to discharge the air into the discharge passage 38, and is restored into its original shape. Therefore, the air chamber 36 absorbs the shock generated when the foot's sole comes into contact with the ground to alleviate fatigue.

The air supplied from the discharge passage 38 is discharged into the discharge holes 44*a* and 44*b* through the first and second branches 40*a* and 40*b* formed by the first and second bent portions 42*a* and 42*b*. The air supplied from the discharge holes 44*a* and 44*b* is locally discharged to toes, where sweat easily, in the footwear through the vent holes 46*a* and 46*b* formed at the front of the insole 14, thereby obtaining the ventilating function.

The above ventilating and shock-absorbing functions are repeatedly achieved when walking.

With the above description, the ventilated footwear with the ventilation and shock-absorbing device according to the present invention has the following effects.

Since the air pump is provided at the front with the air tube having the air chamber expandable by the inflow of the air, the air chamber serves as a cushion when walking, thereby reducing the shock applied to the foot and so alleviating the fatigue.

It is adapted to locally supply the air to a portion where sweats easily, thereby increasing a ventilation performance.

The size of the discharge passage may be selected according to a desired purpose, thereby properly adjusting the ventilating and cushioning functions. The air may be differentially supplied between the toes by differently manufacturing the size of the first and second branches.

The air discharged in the footwear may be mixed with the far infrared rays or components useful to the human.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A ventilated footwear comprising:

a shoe sole:

an air pump provided at a rear portion of the shoe sole:

an inlet passage disposed at a front of the air pump, the inlet passage having a check valve for allowing air flow in a direction from the air pump but preventing air flow in an opposite direction:

an air chamber provided at a front portion of the shoe sole, the air chamber having an enlarged area for storing air supplied from the air pump through the inlet passage connected to the check valve and thereby enabling shock absorbing with the air stored in the air chamber; and one or more discharge holes disposed at the air chamber for discharging the air stored in the air chamber into the footwear for ventilation;

wherein a discharge passage is formed between the air chamber and the discharge holes to discharge the air from the air chamber to the discharge holes, the discharge passage being provided at a front thereof with first and second bent portions forming first and second branches for supplying the air into the discharge holes; and wherein the branches have different diameter.

2. The footwear as claimed in claim 1, wherein the air chamber is filled with a functional member.

3. The footwear as claimed in claim 2, wherein the functional member is for providing or radiating far infrared rays or materials useful to a human.

4. The footwear as claimed in claim 3, wherein the functional member comprises a material selected from a group consisting of germanium, charcoal, and deodorizer.

5. The footwear as claimed in claim 1, wherein the air pump includes an intake hole formed at a wall of the air pump, the intake hole in fluid communication with an interior area of the footwear for receiving air to the air pump.

6. The footwear as claimed in claim 5, wherein the air pump further includes a resilient film attached to an inner side of the intake hole for alternately opening and closing the intake hole.

7. The footwear as claimed in claim 1, wherein the shoe sole includes an insole and an outsole, and the air pump and air chamber are disposed between the insole and the outsole.

8. The footwear as claimed in claim 1, wherein the insole includes one or more vent holes in proximity and fluid communication with the one or more discharge holes of the air chamber.

9. A ventilated footwear comprising:

a shoe sole:

an air pump provided at a rear portion of the shoe sole:

an inlet passage disposed at a front of the air pump, the inlet passage having a check valve for allowing air flow in a direction from the air pump but preventing air flow in an opposite direction:

an air chamber provided at a front portion of the shoe sole, the air chamber having an enlarged area for storing air supplied from the air pump through the inlet passage connected to the check valve and thereby enabling shock absorbing with the air stored in the air chamber; and one or more discharge holes disposed at the air chamber for discharging the air stored in the air chamber into the footwear for ventilation;

wherein a discharge passage is formed between the air chamber and the discharge holes to discharge the air from the air chamber to the discharge holes, the discharge passage being provided at a front thereof with first and second bent portions forming first and second branches for supplying the air into the discharge holes; and wherein the first and second bent portions have different length.

10. The footwear as claimed in claim 9, wherein the air chamber is filled with a functional member.

11. The footwear as claimed in claim 10, wherein the functional member is for providing or radiating far infrared rays or materials useful to a human.

12. The footwear as claimed in claim 11, wherein the functional member comprises a material selected from a group consisting of germanium, charcoal, and deodorizer.

13. The footwear as claimed in claim 9, wherein the air pump includes an intake hole formed at a wall of the air pump, the intake hole in fluid communication with an interior area of the footwear for receiving air to the air pump.

14. The footwear as claimed in claim 13, wherein the air pump further includes a resilient film attached to an inner side of the intake hole for alternately opening and closing the intake hole.

15. The footwear as claimed in claim 9, wherein the shoe sole includes an insole and an outsole, and the air pump and air chamber are disposed between the insole and the outsole.

16. The footwear as claimed in claim 9, wherein the insole includes one or more vent holes in proximity and fluid communication with the one or more discharge holes of the air chamber.

* * * * *